US011788377B2

(12) United States Patent
Al Sulaiman et al.

(10) Patent No.: US 11,788,377 B2
(45) Date of Patent: Oct. 17, 2023

(54) DOWNHOLE INFLOW CONTROL

(71) Applicant: Saudi Arabian Oil Company, Dhahran (SA)

(72) Inventors: Ahmed A. Al Sulaiman, Dammam (SA); Suresh Jacob, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/521,312

(22) Filed: Nov. 8, 2021

(65) Prior Publication Data

US 2023/0144758 A1 May 11, 2023

(51) Int. Cl.
*E21B 34/06* (2006.01)

(52) U.S. Cl.
CPC ..... *E21B 34/063* (2013.01); *E21B 2200/08* (2020.05)

(58) Field of Classification Search
CPC ..... E21B 34/14; E21B 34/063; E21B 34/142; E21B 2200/08
See application file for complete search history.

(56) References Cited

U.S. PATENT DOCUMENTS

| | | | |
|---|---|---|---|
| 6,516,275 | B2 | 2/2003 | Lazaratos |
| 6,549,879 | B1 | 4/2003 | Cullick et al. |
| 6,931,324 | B2 | 8/2005 | Taner et al. |
| 7,088,639 | B2 | 8/2006 | Wells et al. |
| 7,376,517 | B2 | 5/2008 | Rickett |
| 7,555,389 | B2 | 6/2009 | Cavalca et al. |
| 8,631,877 | B2 | 1/2014 | Gewily |
| 9,031,820 | B2 | 5/2015 | Frederick |
| 9,506,325 | B2 | 11/2016 | Fould et al. |
| 10,150,713 | B2 * | 12/2018 | Doud ..... E21B 33/12 |

(Continued)

FOREIGN PATENT DOCUMENTS

| | | |
|---|---|---|
| CA | 2802988 | 12/2011 |
| CA | 2899222 | 1/2017 |

(Continued)

OTHER PUBLICATIONS

Abdel-Basset et al., "Chemical and Mechanical Water Shut-Off in Horizontal Passive ICD Wells; Experience and Lessons Learnt in Giant Darcy Reservoir," IPTC-20210-MS, International Petroleum Technology Conference (IPTC), presented at the International Petroleum Technology Conference, Dhahran, Saudi Arabia, Jan. 13-15, 2020, 29 pages.

(Continued)

*Primary Examiner* — Christopher J Sebesta
(74) *Attorney, Agent, or Firm* — Fish & Richardson P.C.

(57) ABSTRACT

An apparatus includes a funnel, a core, a first coating, a second coating, and a third coating. The funnel includes multiple inlet ports and an outlet port. The core is disposed within the funnel. The first coating is disposed on and surrounds an outer surface of the core. The first coating is configured to dissolve in response to being exposed to water. The second coating is disposed on and surrounds an outer surface of the first coating. The second coating is configured to dissolve in response to being exposed to water. The third coating is disposed on and surrounds an outer surface of the second coating. The third coating is configured to dissolve in response to being exposed to a hydrocarbon.

18 Claims, 8 Drawing Sheets

(56) References Cited

U.S. PATENT DOCUMENTS

| | | | | |
|---|---|---|---|---|
| 10,563,483 | B2 | 2/2020 | Steele | |
| 10,590,741 | B2 | 3/2020 | Van Der Veen et al. | |
| 2009/0326826 | A1 | 12/2009 | Hull et al. | |
| 2010/0097886 | A1 | 4/2010 | Day et al. | |
| 2012/0276356 | A1* | 11/2012 | Xu | E21B 41/00 428/218 |
| 2013/0032357 | A1* | 2/2013 | Mazyar | E21B 34/063 166/376 |
| 2014/0170025 | A1 | 6/2014 | Weiner et al. | |
| 2015/0159462 | A1* | 6/2015 | Cutler | E21B 43/261 166/377 |
| 2015/0168573 | A1 | 6/2015 | Zhang et al. | |
| 2016/0091623 | A1 | 3/2016 | Yu et al. | |
| 2016/0178772 | A1 | 6/2016 | Carter | |
| 2017/0321547 | A1 | 11/2017 | Enkababian et al. | |
| 2020/0095851 | A1 | 3/2020 | Stojkovic et al. | |

FOREIGN PATENT DOCUMENTS

| | | |
|---|---|---|
| WO | WO 2011106579 | 9/2011 |
| WO | WO 2013044300 | 4/2013 |
| WO | WO 2014168617 | 10/2014 |
| WO | WO 2018045255 | 3/2018 |
| WO | WO 2018111103 | 6/2018 |
| WO | WO 2019099038 | 5/2019 |

OTHER PUBLICATIONS

Abubaker et al., "Technology Trial Review: Selective Coiled Tubing Re-Entry of Two Open Hole Multilateral Wells Using Intelligent Electromechanical Arm," SPE-182996-MS, Society of Petroleum Engineers (SPE), presented at the Abu Dhabi International Petroleum Exhibition & Conference, Abu Dhabi, UAE, Nov. 7-10, 2016, 14 pages.

Al-Khaldy et al., "First-Ever Level 4 Multilateral Well in North Kuwait Successfully Completed, Improves Oil Production," SPE-171792-MS, Society of Petroleum Engineers (SPE), presented at the Abu Dhabi International Petroleum Exhibition and Conference, Abu Dhabi, UAE, Nov. 10-13, 2014, 12 pages.

Aruhke et al., "Technology Evolution in a Giant Saudi Aramco's Field Development," WPC-21-0182, Work Petroleum Congress (WPC), presented at the 21st World Petroleum Congress, Moscow, Russia, Jun. 2014, 17 pages.

Ertekin et al., "Artificial Intelligence Applications in Reservoir Engineering: A Status Check," Energies, Jul. 2019, XP055776157, 12(15): 2897, 22 pages.

Halliburton [online], "Digital Twin Implementation for Integrated Production & Reservoir Management," iEnergy, 2018, retrieved on Sep. 27, 2019, retrieved from URL: <https://www.ienergy.community/Portals/1/IenergyDocs/Marketing/DigitalTwin_Integrated_Reservoir_Production.pdf>. 17 pages.

Halliburton, "IsoRite Isolated Multilateral Completion Systems: For multilateral wells that require re-entry capability to access the lateral," 2018, 3 pages.

Kais, et al., "First Autonomous Inflow Control Valve AICV Well Completion Deployed in a Field Under an EOR Water and CO2 Injection Scheme," Society of Petroleum Engineers, SPE Annual Technical Conference and Exhibition, Sep. 2016.

Luo et al., "A novel polymer encapsulated silica nanoparticles for water control in development of fossil hydrogen energy-tight carbonate oil reservoir by acid fracturing," International Journal of Hydrogen Energy, Jul. 2021.

Matheisen et al., "Autonomous Valve Controls Excess Water, Gas Production to Increase Oil Recovery," Journal of Petroleum Technology, 2020, 72(06), 44-46.

Mohaghegh, "Reservoir simulation and modeling based on artificial intelligence and data mining (AI&DM)," Journal of Natural Gas Science and Engineering, Aug. 2011, 3(6): 697-705, XP028125623, 9 pages.

ResFloW Sliding Sleeve ICD by Schlumberger brochure, 2015.

Saeed et al., "Multilateral Reentry System for Well Surveillance: Design, Implementation and Summary of 40 Jobs Performed in Fields," SPE-199849-MS, Society of Petroleum Engineers (SPE), presented at the SPE/ICoTA Well Intervention Conference and Exhibition, The Woodlands, Texas, Mar. 24-25, 2020, 9 pages.

Saumya et al., "Saturation Forecast Using Machine Learning: Enabling Smarter Decision-Making Capabilities," SPE-197419-MS, Society of Petroleum Engineers, Nov. 2019, XP055796992, 10 pages.

Schlumberger, "SLIC: Selective lateral intervention completion system," 2019, 2 pages.

Sharma et al., "New Generation Inflow Control Device to Maximize Well Productivity During Every Phase of a Well's Life," Society of Petroleum Engineers, SPE/IATMI Asia Pacific Oil & Gas Conference and Exhibition, Oct. 2017.

slb.com [online], "Discovery MLT, Multilateral reentry system," available on or before Feb. 24, 2021, retrieved from URL <https://www.slb.com/well-intervention/coiled-tubing-intervention/mechanical-intervention/discovery-mlt-multilateral-reentry-system>, 3 pages.

Sudakov et al., "Artificial Neural Network Surrogate Modeling of Oil Reservoir: A Case Study," Springer International Publishing, Cham, Advances in Neural Networks—ISNN 2019, Lecture Notes in Computer Science, Jun. 2019, 11555: 232-241.

Taghavi et al., "Verification of Autonomous Inflow Control Valve Flow Performance Within Heavy Oil-SAGD Thermal Flow Loop," Society of Petroleum Engineers, SPE Annual Technical Conference and Exhibition, Oct. 2019.

Taha et al., "Importance of Water Chemistry in Oil and Gas Operations—Properties and Composition," International Journal of Organic Chemistiy, Feb. 2019, 9, 23-36.

Vaferi et al., "Hydrocarbon reservoir model detection from pressure transient data using coupled artificial neural network—Wavelet transform approach," Applied Soft Computing, Elsevier, Amsterdam, NL, Jun. 2016, XP029661645, 47: 63-75, 13 pages.

Xindi et al., "Comprehensive Review of Water Shutoff Methods for Horizontal Wells," Petroleum Exploration and Development, Dec. 2017, 44:6 (1022-1029), 8 pages.

PCT International Search Report and Written Opinion in International Appln. No. PCT/US2022/049140, dated Feb. 27, 2023, 12 pages.

* cited by examiner

100

200

300

400

DOWNHOLE INFLOW CONTROL

TECHNICAL FIELD

This disclosure relates to downhole inflow control, and in particular, downhole automatic water shut off.

BACKGROUND

Premature water breakthrough in hydrocarbon production from reservoirs can be a major challenge in oil and gas operations. Water production from sections, for example, along horizontal wells can be due to reservoir heterogeneity and can adversely impact hydrocarbon recovery, well life, and well economics. Inflow control devices are typically used to control water production from hydrocarbon reservoirs.

SUMMARY

This disclosure describes technologies relating to downhole inflow control, and in particular, downhole automatic water reduction and shut off. Certain aspects of the subject matter described can be implemented as an apparatus. The apparatus includes a funnel, a core, a first coating, a second coating, and a third coating. The funnel includes multiple inlet ports. The funnel includes an outlet port. The core is disposed within the funnel. The core defines a first outer diameter. The outlet port has an inner diameter that is less than the first outer diameter of the core. The first coating is disposed on and surrounds an outer surface of the core. The first coating defines a second outer diameter. The first coating is configured to dissolve at a first dissolution rate in response to being exposed to water or a fluid including water. The second coating is disposed on and surrounds an outer surface of the first coating. The second coating defines a third outer diameter. The second coating is configured to dissolve at a second dissolution rate different from the first dissolution rate in response to being exposed to water or a fluid including water. The third coating is disposed on and surrounds an outer surface of the second coating. The third coating defines a fourth outer diameter. The third coating is configured to dissolve in response to being exposed to a hydrocarbon or a fluid including a hydrocarbon. The third coating can be configured to be resistant to dissolving in response to being exposed to water.

This, and other aspects, can include one or more of the following features. In some implementations, the second dissolution rate of the second coating is less than the first dissolution rate of the first coating. In some implementations, the first coating has a first thickness, and the second coating has a second thickness. In some implementations, a difference between the first thickness of the first coating and the second thickness of the second coating is less than 0.1 centimeters. In some implementations, the third coating has a third thickness. In some implementations, a difference between the third thickness of the third coating and the first thickness of the first coating is less than 0.1 centimeters. In some implementations, the third thickness of the third coating is in a range of from about 50% to about 100% of the first thickness of the first coating. In some implementations, the funnel includes a first end, a second end, and a wall that spans from the first end to the second end. In some implementations, the wall defines a longitudinal axis through the first end and the second end. In some implementations, the wall has a first cross-sectional area at the first end and a second cross-sectional area at the second end. In some implementations, the first cross-sectional are and the second cross-sectional area are perpendicular to the longitudinal axis. In some implementations, the first cross-sectional area is greater than the second cross-sectional area. In some implementations, the core coated with the first coating, the second coating, and the third coating is disposed between the first end and the second end of the funnel. In some implementations, a first inlet port of the multiple inlet ports is disposed on the first end of the funnel. In some implementations, the outlet port is disposed on the second end of the funnel. In some implementations, a second inlet port of the multiple inlet ports is disposed on the wall of the funnel at a first distance from the first end along the longitudinal axis. In some implementations, the wall has a third cross-sectional area at the first distance. In some implementations, the third cross-sectional area is perpendicular to the longitudinal axis. In some implementations, the third cross-sectional area has an inner diameter that is less than the third outer diameter and greater than the second outer diameter. In some implementations, a third inlet port of the multiple ports is disposed on the wall of the funnel at a second distance from the first end along the longitudinal axis. In some implementations, the wall has a fourth cross-sectional area at the second distance. In some implementations, the fourth cross-sectional area is perpendicular to the longitudinal axis. In some implementations, the fourth cross-sectional area has an inner diameter that is less than the second outer diameter and greater than the first outer diameter.

Certain aspects of the subject matter described can be implemented as a system. The system includes a tubular disposed within a wellbore formed in a subterranean formation. The system includes an inflow control device disposed on the tubular. The inflow control device is configured to control flow of wellbore fluid from the wellbore and into the tubular. The inflow control device includes a funnel, a core, a first coating, a second coating, and a third coating. The funnel includes multiple inlet ports. The funnel includes an outlet port. The core is disposed within the funnel. The core defines a first outer diameter. The outlet port has an inner diameter that is less than the first outer diameter of the core. The first coating is disposed on and surrounds an outer surface of the core. The first coating defines a second outer diameter. The first coating is configured to dissolve at a first dissolution rate in response to being exposed to water or a fluid including water. The second coating is disposed on and surrounds an outer surface of the first coating. The second coating defines a third outer diameter. The second coating is configured to dissolve at a second dissolution rate different from the first dissolution rate in response to being exposed to water or a fluid including water. The third coating is disposed on and surrounds an outer surface of the second coating. The third coating defines a fourth outer diameter. The third coating is configured to dissolve in response to being exposed to a hydrocarbon or a fluid including a hydrocarbon. The third coating can be configured to be resistant to dissolving in response to being exposed to water.

This, and other aspects, can include one or more of the following features. In some implementations, the second dissolution rate of the second coating is less than the first dissolution rate of the first coating. In some implementations, the first coating has a first thickness, and the second coating has a second thickness. In some implementations, a difference between the first thickness of the first coating and the second thickness of the second coating is less than 0.1 centimeters. In some implementations, the third coating has a third thickness. In some implementations, a difference between the third thickness of the third coating and the first thickness of the first coating is less than 0.1 centimeters. In some implementations, the third thickness of the third coating is in a range of from about 50% to about 100% of the first thickness of the first coating. In some implementations, the funnel includes a first end, a second end, and a wall that spans from the first end to the second end. In some implementations, the wall defines a longitudinal axis through the first end and the second end. In some implementations, the wall has a first cross-sectional area at the first end and a second cross-sectional area at the second end. In some implementations, the first cross-sectional are and the second cross-sectional area are perpendicular to the longitudinal axis. In some implementations, the first cross-sectional area is greater than the second cross-sectional area. In some implementations, the core coated with the first coating, the second coating, and the third coating is disposed between the first end and the second end of the funnel. In some implementations, a first inlet port of the multiple inlet ports is disposed on the first end of the funnel. In some implementations, the outlet port is disposed on the second end of the funnel. In some implementations, a second inlet port of the multiple inlet ports is disposed on the wall of the funnel at a first distance from the first end along the longitudinal axis. In some implementations, the wall has a third cross-sectional area at the first distance. In some implementations, the third cross-sectional area is perpendicular to the longitudinal axis. In some implementations, the third cross-sectional area has an inner diameter that is less than the third outer diameter and greater than the second outer diameter. In some implementations, a third inlet port of the multiple ports is disposed on the wall of the funnel at a second distance from the first end along the longitudinal axis. In some implementations, the wall has a fourth cross-sectional area at the second distance. In some implementations, the fourth cross-sectional area is perpendicular to the longitudinal axis. In some implementations, the fourth cross-sectional area has an inner diameter that is less than the second outer diameter and greater than the first outer diameter.

Certain aspects of the subject matter described can be implemented as a method. An apparatus is disposed within a wellbore formed in a subterranean formation. The apparatus includes a funnel, a core, a first coating, a second coating, and a third coating. The funnel includes multiple inlet ports. The funnel includes an outlet port. The core is disposed within the funnel. The core defines a first outer diameter. The outlet port has an inner diameter that is less than the first outer diameter of the core. The first coating is disposed on and surrounds an outer surface of the core. The first coating defines a second outer diameter. The first coating is configured to dissolve at a first dissolution rate in response to being exposed to water or a fluid including water. The second coating is disposed on and surrounds an outer surface of the first coating. The second coating defines a third outer diameter. The second coating is configured to dissolve at a second dissolution rate different from the first dissolution rate in response to being exposed to water or a fluid including water. The third coating is disposed on and surrounds an outer surface of the second coating. The third coating defines a fourth outer diameter. The third coating is configured to dissolve in response to being exposed to a hydrocarbon or a fluid including a hydrocarbon. The third coating can be configured to be resistant to dissolving in response to being exposed to water. Wellbore fluid from the subterranean formation is received by the multiple inlet ports of the funnel. The wellbore fluid includes a hydrocarbon and water. The wellbore fluid is directed to the core by the funnel. The third coating is contacted with the hydrocarbon of the wellbore fluid to dissolve the third coating. In response to dissolving the third coating, the ball is moved toward the outlet port and the second coating is exposed to the wellbore fluid. The second coating is contacted with the water of the wellbore fluid to dissolve the second coating. In response to dissolving the second coating, fluid communication between a first portion of the inlet ports and the outlet port is obstructed by the core with the second and third coatings dissolved, such that fluid flow through the apparatus and out of the outlet port decreases. The first coating is contacted with the water of the wellbore fluid to dissolve the first coating. In response to dissolving the first coating, fluid communication between a remaining portion of the inlet ports and the outlet port is obstructed by the core with the first, second, and third coatings dissolved, such that the fluid flow through the apparatus and out of the outlet port is prevented.

This, and other aspects, can include one or more of the following features. In some implementations, the second dissolution rate of the second coating is less than the first dissolution rate of the first coating. In some implementations, the first coating has a first thickness, and the second coating has a second thickness. In some implementations, a difference between the first thickness of the first coating and the second thickness of the second coating is less than 0.1 centimeters. In some implementations, the third coating has a third thickness. In some implementations, a difference between the third thickness of the third coating and the first thickness of the first coating is less than 0.1 centimeters. In some implementations, the third thickness of the third coating is in a range of from about 50% to about 100% of the first thickness of the first coating. In some implementations, the funnel includes a first end, a second end, and a wall that spans from the first end to the second end. In some implementations, the wall defines a longitudinal axis through the first end and the second end. In some implementations, the wall has a first cross-sectional area at the first end and a second cross-sectional area at the second end. In some implementations, the first cross-sectional are and the second cross-sectional area are perpendicular to the longitudinal axis. In some implementations, the first cross-sectional area is greater than the second cross-sectional area. In some implementations, the core coated with the first coating, the second coating, and the third coating is disposed between the first end and the second end of the funnel. In some implementations, a first inlet port of the multiple inlet ports is disposed on the first end of the funnel. In some implementations, the outlet port is disposed on the second end of the funnel. In some implementations, a second inlet port of the multiple inlet ports is disposed on the wall of the funnel at a first distance from the first end along the longitudinal axis. In some implementations, the wall has a third cross-sectional area at the first distance. In some implementations, the third cross-sectional area is perpendicular to the longitudinal axis. In some implementations, the third cross-sectional area has an inner diameter that is less than the third outer diameter and greater than the second outer diameter, such that a center of the core with the second and third coatings dissolved is disposed between the second inlet port and the outlet port, thereby obstructing fluid communication between the first portion of the inlet ports and the outlet port. In some implementations, a third inlet port of the multiple ports is disposed on the wall of the funnel at a second distance from the first end along the longitudinal axis. In some implementations, the wall has a fourth cross-sectional area at the second distance. In some implementations, the fourth cross-sectional area is perpendicular to the longitudinal axis. In some implementations, the fourth cross-sectional area has an inner diameter that is less than the second outer diameter and greater than the first outer diameter, such that the center of the core with the first, second, and third coatings dissolved is disposed between the third inlet port and the outlet port, thereby obstructing fluid communication between the inlet ports and the outlet port, such that fluid flow through the apparatus and out of the outlet port is prevented.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

Figure 1A:
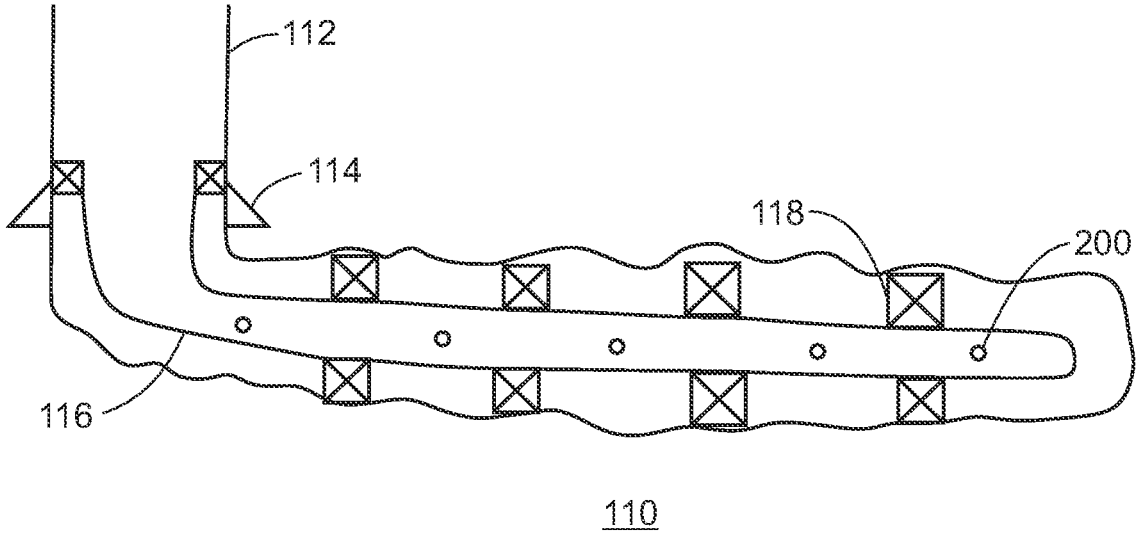
FIG. 1A is a schematic diagram of an example well.

This disclosure describes an autonomous inflow control device (ICD) that can successfully perform water shut off without depending on viscosity or density differences between oil and water phases. The ICD includes a funnel with multiple inlet ports, for example, on the top and on the sides. The funnel also includes an outlet port located near the tapered end of the funnel, such that a general fluid flow direction is toward the tapered end. The ICD includes a core disposed within the funnel, and the core is coated with multiple layers of chemicals. The core can be, for example, a non-dissolvable core, and the layers of coating are such that the core and the layers of coating together are in the form of a ball. Each layer is dissolvable based on exposure to certain fluids, such as oil and/or water. As the layers dissolve, the ball's outer diameter decreases and the overall direction of fluid flow pushes the ball towards the tapered end of the funnel. Eventually, once all the coated layers have dissolved, the core shuts off the fluid connection between the inlet ports and the outlet port, effectively shutting off fluid flow through the ICD. For example, as the coated layers dissolve, the force generated by the flow of fluids through the funnel pushes the core (which can be non-dissolvable) towards the tapered end of the funnel, and the core will then restrict the flow of fluid out of the outlet, thereby restricting, and if required, shutoff, the fluid flow from the larger end to the tapered end of the funnel.

The subject matter described in this disclosure can be implemented in particular implementations, so as to realize one or more of the following advantages. By implementing several of the described ICDs at various points along a well, inflow of water can be controlled automatically across various producing locations in a well, regardless of heterogeneity. Inflow of water can be controlled and reduced without requiring well intervention, which can be costly and time-consuming. The ICDs described here can adjust inflow automatically without relying on changes in viscosity and/or density of the wellbore fluid that is being produced. Implementation of the subject matter described can increase lifespan of a production well and improve hydrocarbon recovery from a production well. Implementation of the subject matter described can avoid downtime associated with water shutoff techniques that implement dads or plug setting. Implementation of the subject matter described can reduce costs, for example, associated with delayed rigging activities for sidetracking, by eliminating the need for running production logging tools for the purpose of water shutoff intervention, by eliminating the need for well intervention operations for water shutoff, or a combination of these. Implementation of the subject matter described can conserve reservoir pressure (thereby maintaining hydrocarbon production and avoiding excessive pressure loss) and improve well operating efficiency by minimizing water cycling, which involves processing produced water and re-injecting the processed produced water back into the reservoir to boost pressure. The ICDs described here can, once activated, choke flow of fluid in a first direction (for example, from the formation and into a tubing) while allowing flow of fluid in a second direction (for example, from the tubing and to the formation). As such, the ICDs described here can successfully perform water shutoff from the formation while also allowing for injection of treatment fluids to the formation.

FIG. 1A depicts an example well 100 constructed in accordance with the concepts herein. The well 100 extends from the surface through the Earth to one more subterranean zones of interest 110 (one shown). The well 100 enables access to the subterranean zones of interest 110 to allow recovery (that is, production) of fluids to the surface and, in some implementations, additionally or alternatively allows fluids to be placed in the Earth. In some implementations, the subterranean zone 110 is a formation within the Earth defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. The well 100 can be a vertical well or a deviated well with a wellbore deviated from vertical (for example, horizontal or slanted). The well 100 can include multiple bores forming a multilateral well (that is, a well having multiple lateral wells branching off another well or wells).

In some implementations, the well 100 is a gas well that is used in producing hydrocarbon gas (such as natural gas) from the subterranean zones of interest 110 to the surface. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface and extends downhole into the wellbore. The casing 112 operates to isolate the bore of the well 100, defined in the cased portion of the well 100 by the inner bore 116 of the casing 112, from the surrounding Earth. The casing 112 can be formed of a single continuous tubing or multiple lengths of tubing joined (for example, threadedly) end-to-end. In some implementations, the casing 112 is perforated in the subterranean zone of interest 110 to allow fluid communication between the subterranean zone of interest 110 and the bore 116 of the casing 112. In some implementations, the casing 112 is omitted or ceases in the region of the subterranean zone of interest 110 (as shown in FIG. 1A). This portion of the well 100 without casing is often referred to as "open hole." As shown in FIG. 1A, the cased portion of the well 100 can cease at a casing shoe 114.

A production tubing 116 can be installed in the casing 112. The production tubing 116 can extend into the open hole portion of the well 100. The production tubing 116 can be secured by a packer 118. While FIG. 1A depicts four packers 118, the well 100 can include fewer or more packers depending, for example, on the length of the production tubing 116. Each packer 118 surrounds the production tubing 116, centers the production tubing 116 within the wellbore of the well 100, and stabilizes the production tubing 116 during well operations. The well 100 can include an ICD 200. The ICD 200 can, for example, control the flow of fluids from the wellbore and into the production tubing 116. While FIG. 1A depicts five ICDs 200 distributed along the production tubing 116, the well 100 can include fewer or more ICDs depending, for example, on the length of the production tubing 116, characteristics of the well 100 along the length of the production tubing 116, or a combination of both.

Figure 1B:
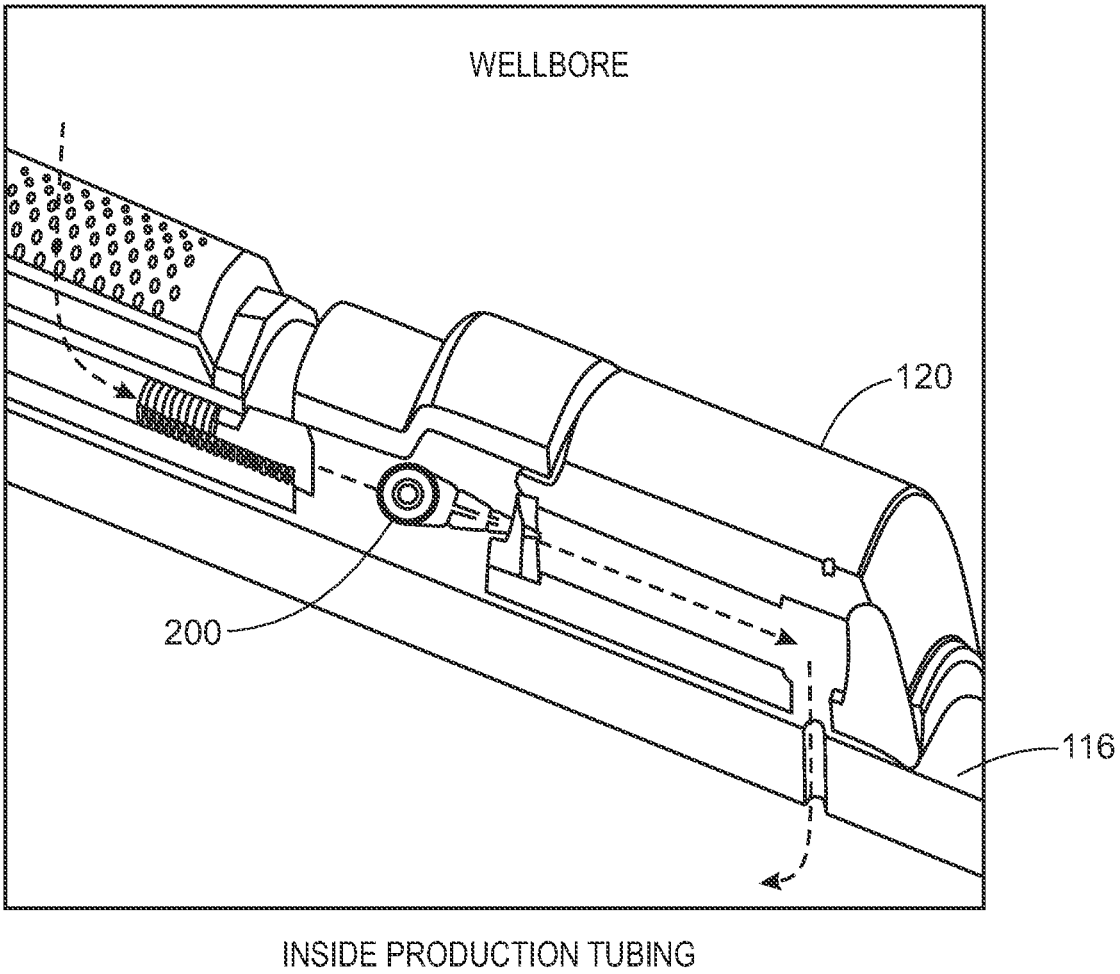
FIG. 1B is a schematic diagram of an inflow control device installed in the well of FIG. 1A.

FIG. 1B depicts the ICD 200 installed in a sleeve 120 that surrounds the production tubing 116. As shown in FIG. 1B, the ICD 200 can be disposed within an annulus of the sleeve 120. The dotted arrows in FIG. 1B depict a general direction of fluid flow from the wellbore, through the sleeve 120 and ICD 200, and into the production tubing 116. Wellbore fluid from the wellbore can flow into the sleeve 120, for example, through perforations defined on an outer surface of the sleeve 120. The wellbore fluid then flows through the annulus of the sleeve 120 and into the ICD 200. The ICD 200 can be disposed within the annulus of the sleeve 120, such that any wellbore fluid that flows from the wellbore and enters the sleeve 120 must flow into the ICD 200 without bypassing the ICD 200. In some configurations, the wellbore fluid freely enters the ICD 200 and exits the ICD 200 and continues to flow through the sleeve 120 and eventually into the production tubing 116. In some configurations, the wellbore fluid is slowed down by an obstruction implemented by the ICD 200 to reduce flow of the wellbore fluid exiting the ICD 200 and into the production tubing 116. In some configurations, flow through the ICD 200 is blocked, such that no fluid exits the ICD 200 and enters the production tubing 116.

Figure 2A:
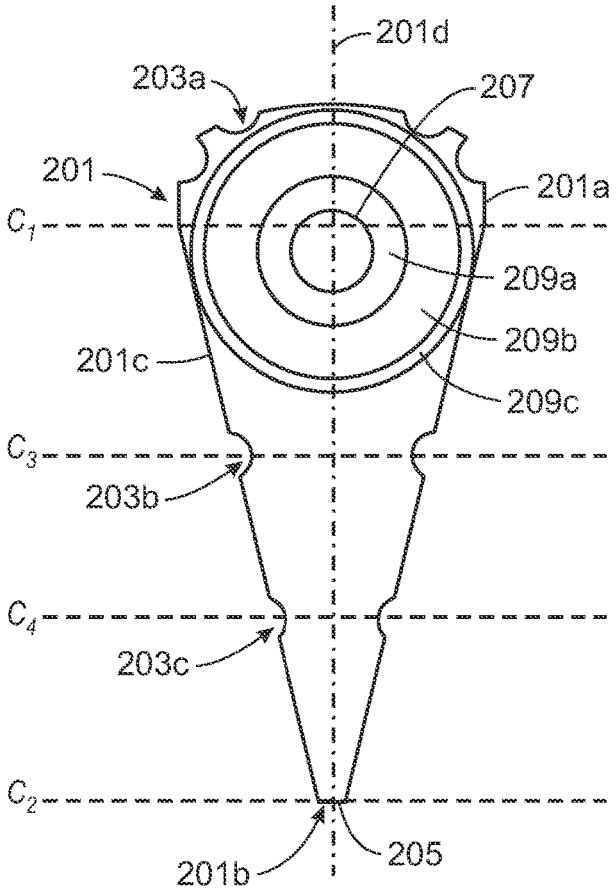
FIG. 2A is a side cross-sectional view of an inflow control device that can be installed in the well of FIG. 1A.

FIG. 2A is a side cross-sectional view of the ICD 200 that can be installed in the well 100. The ICD 200 includes a funnel 201 that includes multiple inlet ports, labeled as 203 followed by a letter (for example, 203*a*). The funnel 201 includes an outlet port 205. The ICD 200 includes a core 207 with a first coating 209*a* disposed on and surrounding an outer surface of the core 207. A second coating 209*b* is disposed on and surrounds an outer surface of the first coating 209*c*. A third coating 209*c* is disposed on and surrounds an outer surface of the second coating 209*b*.

The outlet port 205 has an inner diameter. The outlet port 205 is smaller than the core 207 (even with all of the coatings 209*a*, 209*b*, 209*c* dissolved), such that the core 207 cannot pass through the outlet port 205. The ICD 200 is installed in a configuration such that fluid can flow through the ICD 200 in a general direction toward the tapered end of the funnel 201 (that is, toward the outlet port 205). Therefore, during operation, the general direction of the fluid flow through the ICD 200 biases the core 207 toward the outlet port 205.

The first, innermost coating 209*a* can be disposed directly on the outer surface of the core 207. The first, innermost coating 209*a* is configured to dissolve and/or erode in response to being exposed to water or a fluid including water (such as completion fluid). For example, the first, innermost coating 209*a* is configured to dissolve and/or erode in response to being exposed to a fluid including hydrocarbons and water associated with high water cut (such as water cut greater than 50%). For example, the dissolution rate of the first coating 209*a* in response to being exposed to water or a fluid including water (such as completion fluid) can be about 0.1 millimeters per month (mm/mo) in relation to thickness reduction of the first coating 209*a*. The first coating 209*a* can include, for example, salt-based compounds designed to dissolve in water at a desired dissolution rate. In some cases, the first coating 209*a* includes polyvinyl alcohol. The first coating 209*a* can also include an additive and/or a filler.

The second, intermediate coating 209*b* can be disposed directly on an outer surface of the first, innermost coating 209*a*. The second, intermediate coating 209*b* is configured to dissolve and/or erode in response to being exposed to water or a fluid including water. For example, the second, intermediate coating 209*b* is configured to dissolve and/or erode in response to being exposed to a fluid including hydrocarbons and water associated with low water cut (such as water cut greater than 30% and less than 50%). The dissolution rate of the second coating 209*b* is different from the dissolution rate of the first coating 209*a*. In some implementations, the dissolution rate of the second coating 209*b* is less than the dissolution rate of the first coating 209*a*. For example, the dissolution rate of the second coating 209*b* in response to being exposed to water can be about 0.01 mm/mo in relation to thickness reduction of the second coating 209*b*. The second coating 209*b* can include, for example, salt-based compounds designed to dissolve in water at a desired dissolution rate. In some implementations, the second coating 209*b* includes a matrix embedded with a water-soluble material. In such implementations, in response to being exposed to water, the water-soluble material dissolves, leaving a porous matrix that can erode away. In some implementations, the second coating 209*b* includes a resin that dissolves in water. The second coating 209*b* can also include an additive and/or a filler.

The third, outermost coating 209*c* can be disposed directly on an outer surface of the second, intermediate coating 209*b*. The third, outermost coating 209*c* is configured to stay intact in response to being exposed to water or a fluid including water (for example, insoluble in water) and to dissolve in response to being exposed to a hydrocarbon (for example, oil). For example, the third coating 209*c* dissolves completely in response to being exposed to a hydrocarbon within a matter of hours. The third coating 209*c* can include, for example, a non-polar compound. In some implementations, the third coating 209*c* includes a solid resin made of a highly chlorinated alpha-olefinic polymer which is insoluble in water and soluble in oil. In some implementations, the third coating 209*c* includes a solid non-polar polymer, such as polyisoprene or polybutadiene. The third coating 209*c* can also include an additive and/or a filler.

The funnel 201 and the core 207 are made of a material that is resistant to degradation, dissolution, and/or reacting with wellbore fluids in downhole well conditions. For example, the funnel 201 and the core 207 can be made of a material that does not react with water and hydrocarbons. The funnel 201 can be made of a material that is resistant to corrosion and erosion, for example, a corrosion- and erosion-resistant metal. For example, the funnel 201 is made of Inconel. The core 207 can be made of a material that is resistant to corrosion, for example, a corrosion-resistant metal. For example, the core 207 can be made of Inconel or Teflon.

The funnel 201 can include a first end 201*a*, a second end 201*b*, and a wall 201*c* that spans from the first end 201*a* to the second end 201*b*. The core 207 is disposed between the first end 201*a* and the second end 201*b* of the funnel 201. The wall 201*c* can define a longitudinal axis 201*d* through the first end 201*a* and the second end 201*b*. In some implementations, the wall 201*c* has a longitudinal length (between the first end 201*a* and the second end 201*b*) in a range of from about 2 centimeters (cm) to about 4 cm. The wall 201*c* can have a first cross-sectional area $c_1$ at the first end 201*a* and a second cross-sectional area $c_2$ at the second end 201*b*. The first cross-sectional area $c_1$ and the second cross-sectional area $c_2$ are perpendicular to the longitudinal axis 201*d*. The first cross-sectional area $c_1$ is greater than the second cross-sectional area $c_2$. In some implementations, the first cross-sectional area $c_1$ has an inner diameter of about 1 cm. In some implementations, the second cross-sectional area $c_2$ has an inner diameter of about 0.2 cm.

In some implementations, the outlet port 205 is disposed at the tapered end (second end 201*b*) of the funnel 201. In some implementations, a first inlet port 203*a* is disposed at the first end 201*a* of the funnel 201. In some implementations, a second inlet port 203*b* is disposed on the wall 201*c* of the funnel 201 at a first distance from the first end 201*a* along the longitudinal axis 201*d*. The wall 201*c* can have a third cross-sectional area $c_3$ at the first distance, and the third cross-sectional area $c_3$ can be perpendicular to the longitudinal axis 201*d*. In some implementations, a third inlet port 203*c* is disposed on the wall 201*c* of the funnel 201 at a second distance from the first end 201*a* along the longitudinal axis 201*d*. The wall 201*c* can have a fourth cross-sectional area $c_4$ at the second distance, and the fourth cross-sectional area $c_4$ can be perpendicular to the longitudinal axis 201*d*.

Figure 2B:
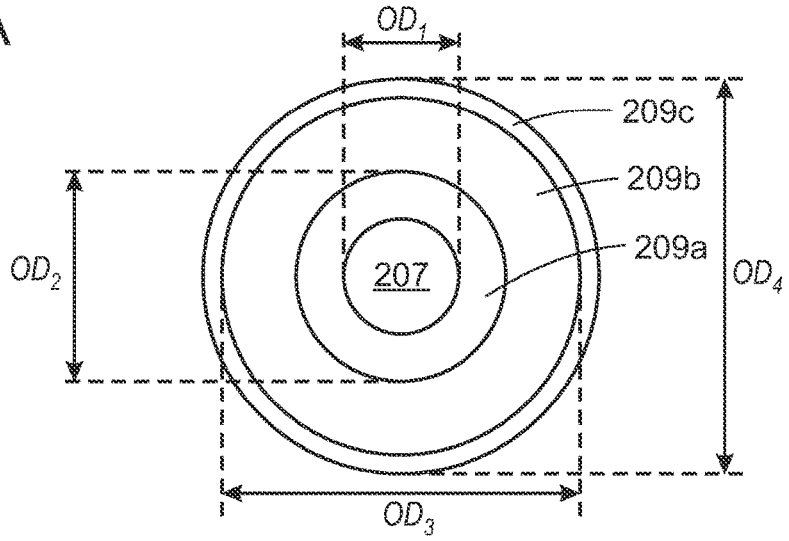
FIG. 2B is a cross-sectional view of a coated core that can be disposed within the inflow control device of FIG. 2A.

FIG. 2B shows a cross-sectional view of the core 207 and the coatings 209*a*, 209*b*, 209*c* surrounding the core 207. The core 207 defines a first outer diameter $OD_1$. The first outer diameter $OD_1$ is less than the inner diameter of the outlet port 205 (FIG. 2A). In some implementations, the first outer diameter $OD_1$ is in a range of from about 0.3 cm to about 0.5 cm. The first coating 209*a* defines a second outer diameter $OD_2$. The second coating 209*b* defines a third outer diameter $OD_3$. The third coating 209*c* defines a fourth outer diameter $OD_4$.

The first coating 209*a* has a first thickness (half of the difference between the second outer diameter $OD_2$ and the first outer diameter OA). In some implementations, the first thickness of the first coating 209*a* is in a range of from about 0.2 cm to about 0.3 cm. The second coating 209*b* has a second thickness (half of the difference between the third outer diameter $OD_3$ and the second outer diameter $OD_2$). In some implementations, the second thickness of the second coating 209*b* is in a range of from about 0.2 cm to about 0.3 cm. The third coating 209*c* has a third thickness (half of the difference between the fourth outer diameter $OD_4$ and the third outer diameter $OD_3$). In some implementations, the third thickness of the third coating 209*c* is in a range of from about 0.1 cm to about 0.2 cm.

In some implementations, the first thickness of the first coating 209*a* and the second thickness of the second coating 209*b* are substantially the same. In some implementations, a difference between the first thickness of the first coating 209*a* and the second thickness of the second coating 209*b* is less than 0.1 centimeters. In some implementations, the third thickness of the third coating 209*c* is substantially the same as the first thickness of the first coating 209*a* or the second thickness of the second coating 209*b*. In some implementations, the third thickness of the third coating 209*c* is less than the first thickness of the first coating 209*a*. In some implementations, the third thickness of the third coating 209*c* is less than the second thickness of the second coating 209*b*. In some implementations, a difference between the first thickness of the first coating 209*a* and the third thickness of the third coating 209*c* is less than 0.1 centimeters. In some implementations, the third thickness of the third coating 209*c* is in a range of from about 50% to about 100% of the first thickness of the first coating 209*a*.

Figure 2C:
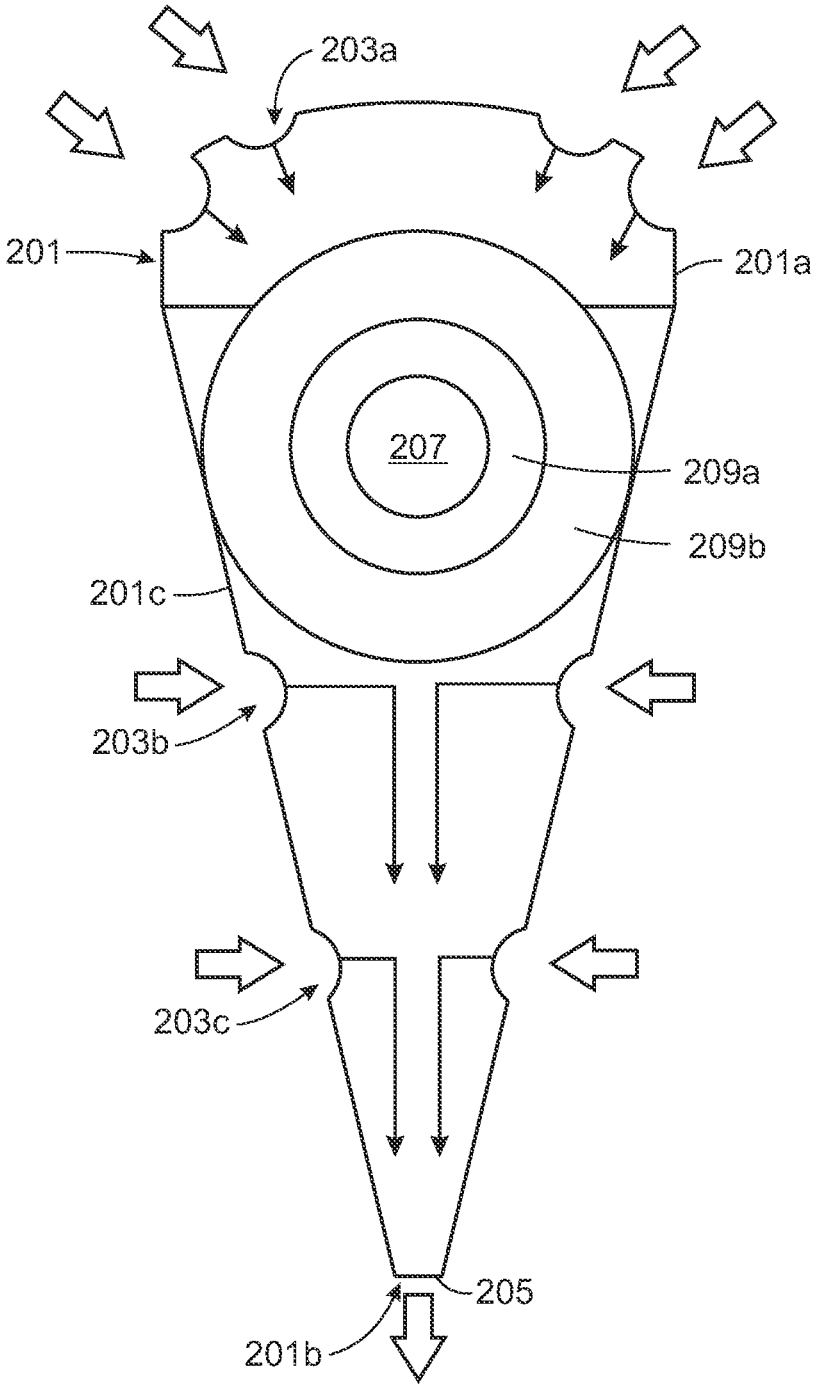
FIG. 2C is a side cross-sectional view of the inflow control device of FIG. 2A, in which a core coating has dissolved.

FIG. 2C is a side cross-sectional view of the ICD 200 in which the third coating 209*c* has dissolved due to exposure to a hydrocarbon (for example, oil). Dissolution of the third coating 209*c* results in a reduction of the outer diameter of the coated core. The general direction of fluid flow through the ICD 200 causes the coated core to move toward the outlet port 205 as the outer diameter of the coated core decreases.

Figure 2D:
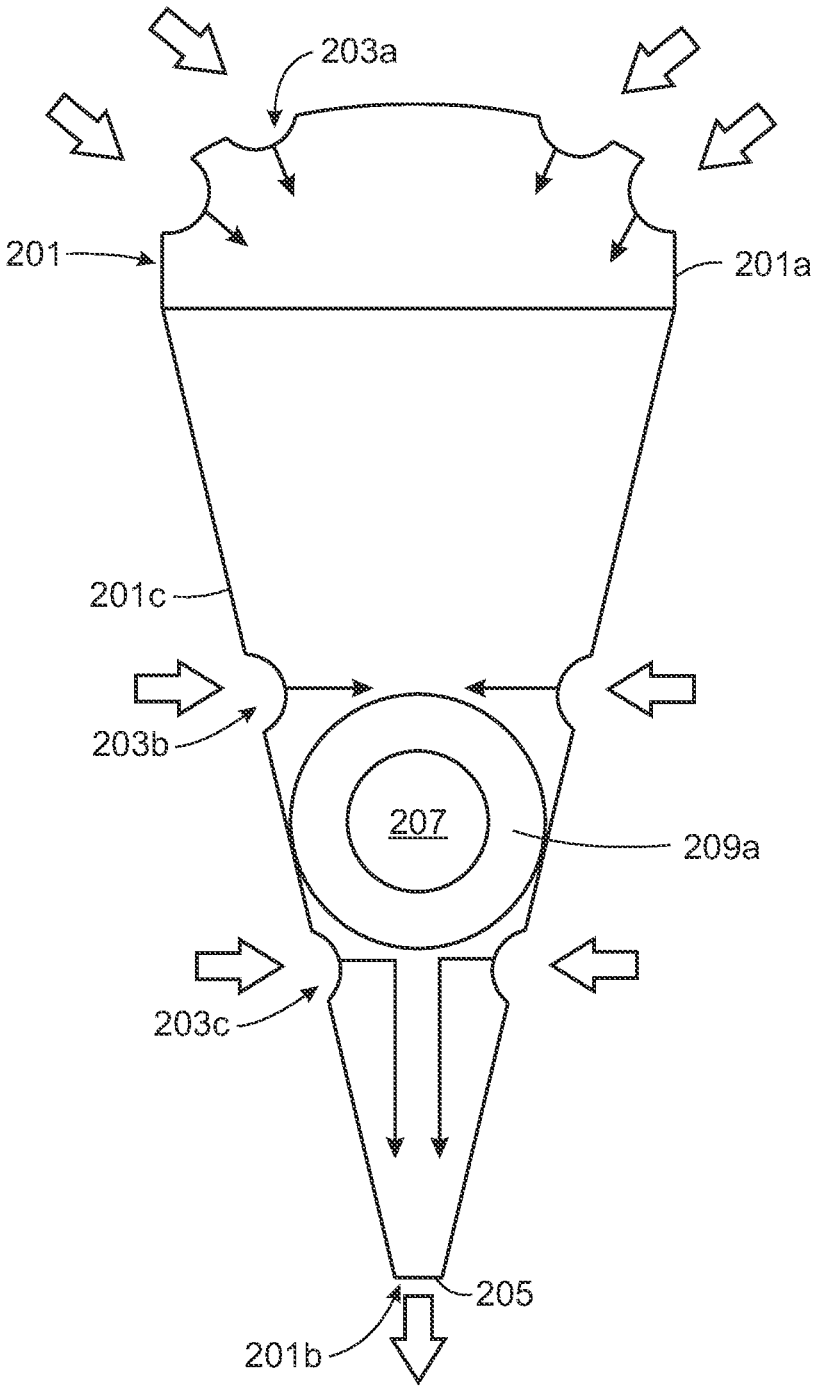
FIG. 2D is a side cross-sectional view of the inflow control device of FIG. 2C, in which a core coating has dissolved.

FIG. 2D is a side cross-sectional view of the ICD 200 in which the second coating 209*b* has dissolved due to exposure to water. The third coating 209*c* has previously dissolved (FIG. 2C). In some implementations, the third cross-sectional area $c_3$ (associated with the second inlet port 203*b*) has an inner diameter that is less than the third outer diameter $OD_3$ (associated with the second coating 209*b*) and greater than the second outer diameter $OD_2$ (associated with the first coating 209*a*). In this instance, a center of the core 207 is between the second inlet port 203*b* and the outlet port 205, and the core 207 obstructs fluid communication between a portion of the inlet ports (for example, the first inlet port 203*a* and the second inlet port 203*b*) and the outlet port 205, such that fluid flow through the ICD 200 and out of the outlet port 205 decreases.

Figure 2E:
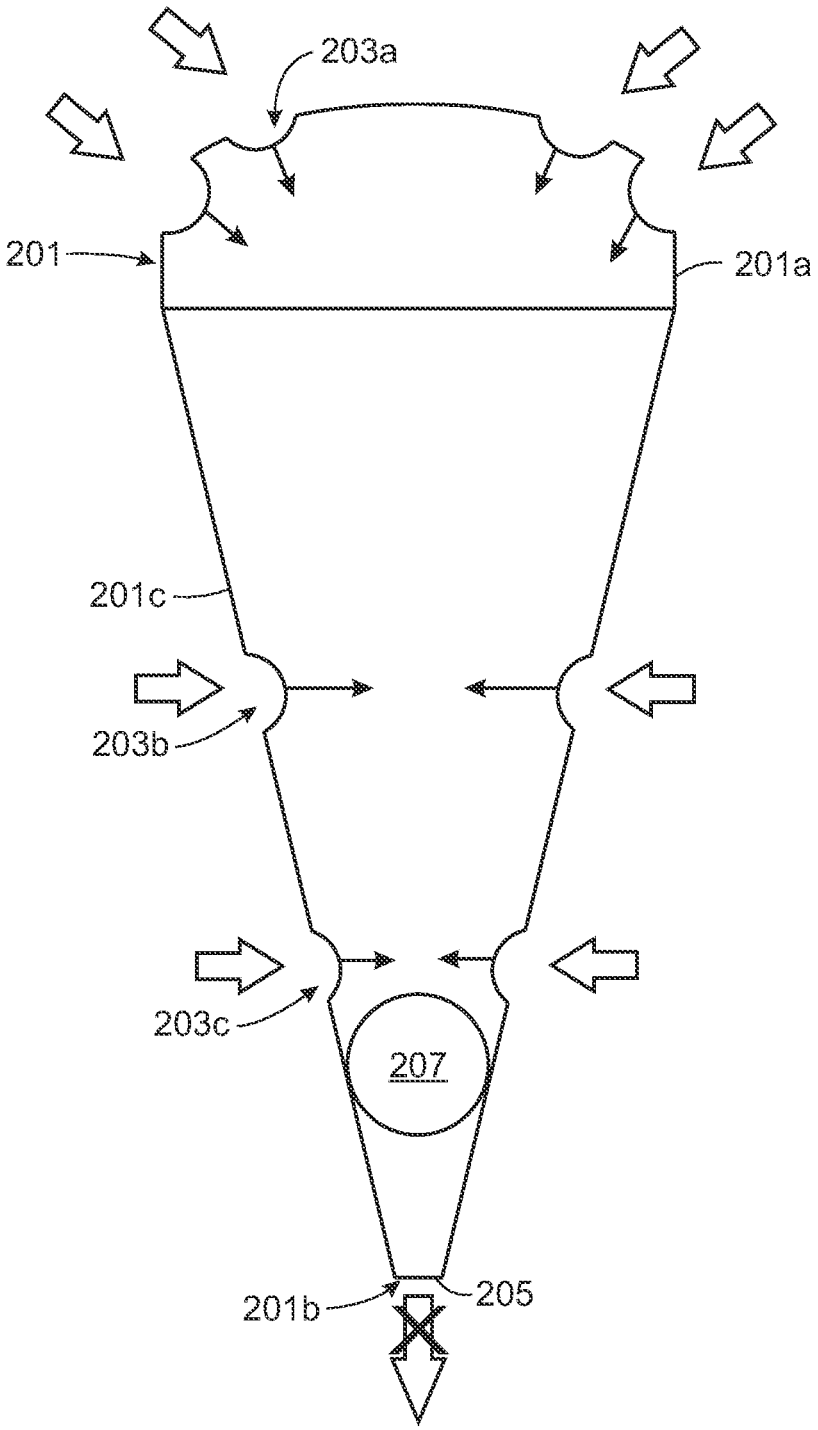
FIG. 2E is a side cross-sectional view of the inflow control device of FIG. 2D, in which a core coating has dissolved.

FIG. 2E is a side cross-sectional view of the ICD 200 in which the first coating 209*a* has dissolved due to exposure to water. The second coating 209*b* and the third coating 209*c* have previously dissolved (FIG. 2D). Therefore, the core 207 is uncoated in this instance. In some implementations, the fourth cross-sectional area $c_4$ (associated with the third inlet port 203*c*) has an inner diameter that is less than the second outer diameter $OD_2$ (associated with the first coating 209*a*) and greater than the first outer diameter $OD_1$ (associated with the core 207 itself). The core 207 can form a seal with the inner wall of the funnel 201. In this instance, the center of the core 207 is between the third inlet port 203*c* and the outlet port 205, and the core 207 obstructs fluid communication between all of the inlet ports (for example, the first inlet port 203*a*, the second inlet port 203*b*, and the third inlet port 203*c*) and the outlet port 205, such that fluid flow through the ICD 200 and out of the outlet port 205 is prevented. That is, fluid does not flow from the wellbore and into the production tubing 116 through the ICD 200 in this configuration.

Figure 3:
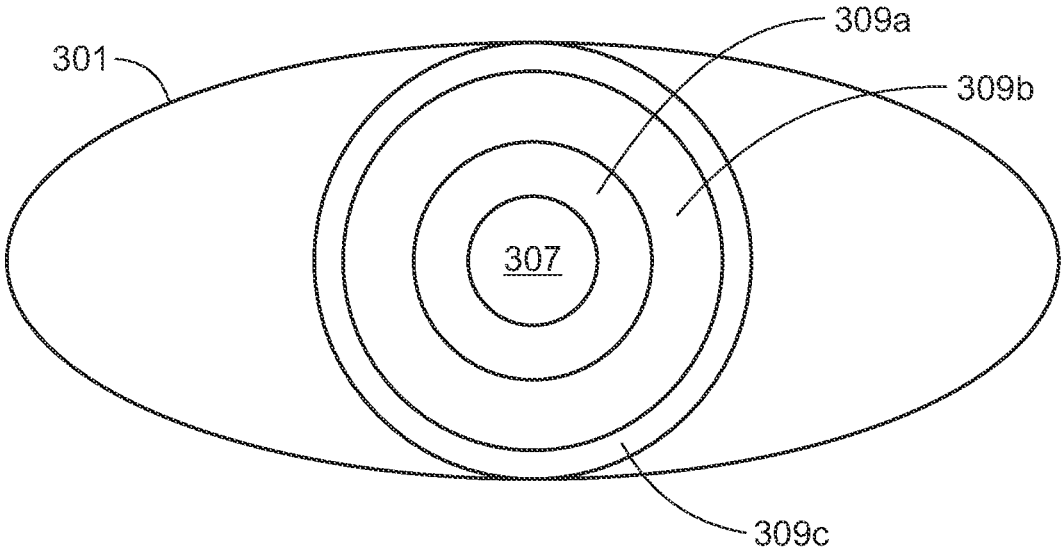
FIG. 3 is a top cross-sectional view of an inflow control device that can be installed in the well of FIG. 1A.

FIG. 3 is a top cross-sectional view of an ICD 300 that is substantially similar to the ICD 200. The ICD 300 includes a funnel 301 that has an elliptic cross-sectional area at its first end, in contrast to the circular cross-sectional area that funnel 201 of ICD 200. In such implementations, an inlet port at the first end of the funnel 301 can be omitted because of the flow areas on opposing sides of the core 307. As the coatings (309*a*, 309*b*, 309*c*) surrounding the core 307 dissolve due to exposure to wellbore fluids, the core 307 travels toward the tapered end (outlet port) of the funnel 301, and the flow areas on opposing sides of the core 307 decrease in size, effectively decreasing the flow rate at which fluid flows through the ICD 300 and out of the outlet port. The cross-sectional area of the funnel 301 becomes gradually more circular approaching the second end of the funnel 301, and the cross-sectional area of the funnel 301 can be completely circular at the second end of the funnel 301 to match the cross-sectional shape of the core 307. Therefore, the core 307 can create a seal with the inner wall of the funnel 301 once all of its coatings have dissolved, such that flow through the ICD 300 and out of the outlet port is prevented. In sum, the ICD 300 can perform similarly as ICD 200.

Figure 4:
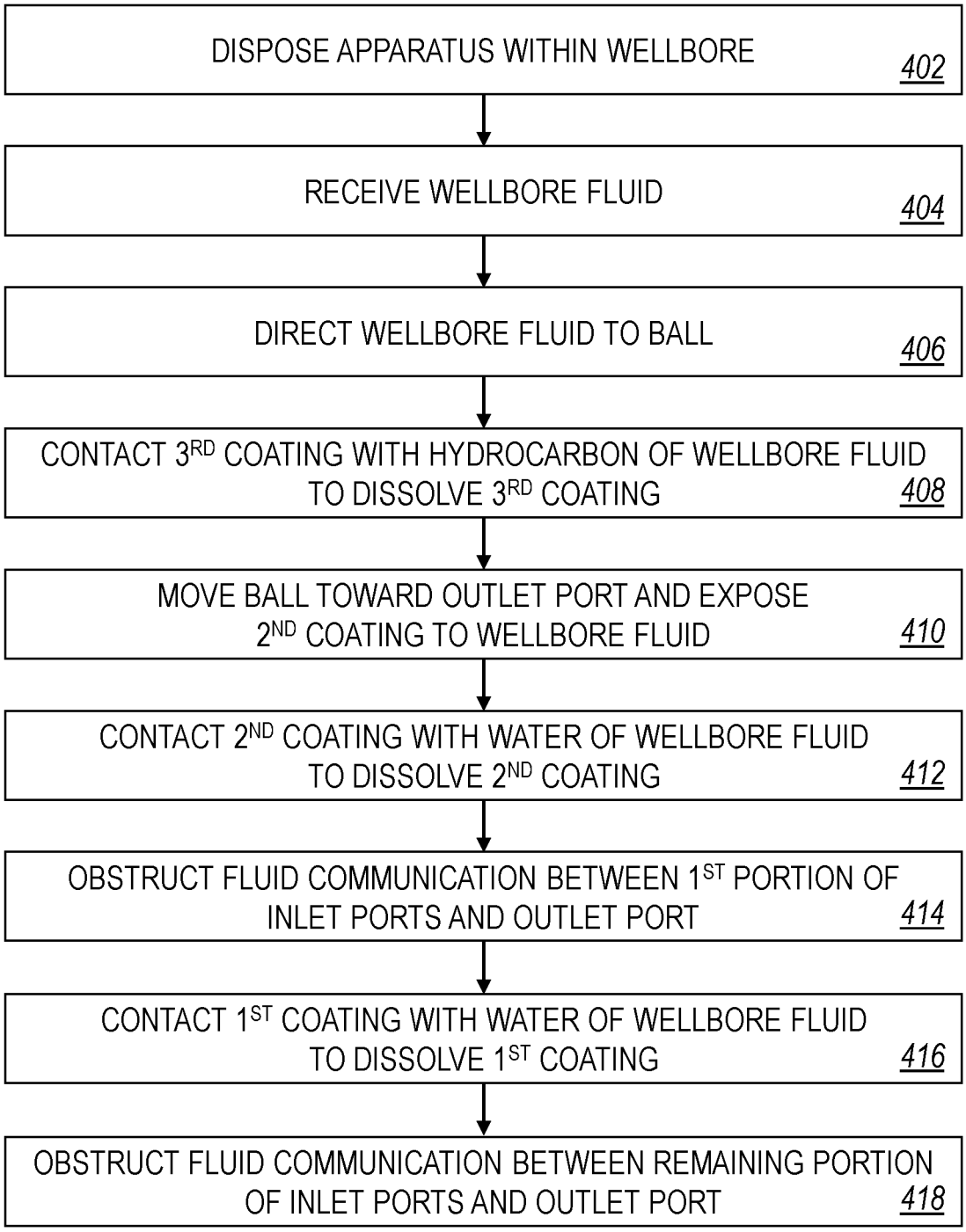
FIG. 4 is a flow chart of a method for controlling flow of wellbore fluid, for example, in the well of FIG. 1A.

FIG. 4 is a flow chart of a method 400 for controlling flow of wellbore fluid, for example, in the well of FIG. 1A. The ICD 200 or 300 can be used for implementing method 400. For simplicity and clarity, method 400 is described in relation to the ICD 200, but the method 400 can also be implemented using the ICD 300. At block 402, the ICD 200 is disposed within a wellbore formed in a subterranean formation (for example, the wellbore of the well 100 of FIG. 1A). At block 404, wellbore fluid is received by the inlet ports (for example, inlet ports 203*a*, 203*b*, and 203*c*) of the funnel 201. As mentioned previously, the wellbore fluid includes a hydrocarbon (such as oil) and water. At block 406, the funnel 201 directs the wellbore fluid to the core 207. At block 408, the third coating 209*c* is contacted with the hydrocarbon of the wellbore fluid to dissolve the third coating 209*c*. In response to dissolving the third coating 209*c* at block 408, the core 207 (with the third coating 209*c* dissolved) is moved toward the outlet port 205 (for example, by the wellbore fluid flowing through the ICD 200), and the second coating 209*b* is exposed to the wellbore fluid at block 410. At block 412, the second coating 209*b* is contacted with the water of the wellbore fluid to dissolve the second coating 209*b*. In response to dissolving the second coating 209*b* at block 412, fluid communication between a first portion of the inlet ports 203 (for example, the first inlet port 203*a* and the second inlet port 203*b*) and the outlet port 205 is obstructed by the core 207 (with the second coating 209*b* and the third coating 209*c* dissolved) at block 414, such that fluid flow through the ICD 200 and out of the outlet port 205 decreases. At block 416, the first coating 209*a* is contacted with the water of the wellbore fluid to dissolve the first coating 209*a*. In response to dissolving the first coating 209*a* at block 416, fluid communication between a remaining portion of the inlet ports 203 (for example, the first inlet port 203*a*, the second inlet port 203*b*, and the third inlet port 203*c*) and the outlet port 205 is obstructed by the core 207 (with the first coating 209*a*, the second coating 209*b*, and the third coating 209*c* dissolved) at block 418, such that fluid flow through the ICD 200 and out of the outlet port 205 is prevented.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. An apparatus comprising:

a funnel comprising:

a first end;

a second end;

a wall spanning from the first end to the second end, the wall defining a longitudinal axis through the first end and the second end, the wall having a first cross-sectional area at the first end and a second cross-sectional area at the second end, the first cross-sectional area and the second cross-sectional area perpendicular to the longitudinal axis, the first cross-sectional area greater than the second cross-sectional area;

a plurality of inlet ports, wherein a first inlet port of the plurality of inlet ports is disposed on the first end of the funnel, and a second inlet port of the plurality of inlet ports is disposed on the wall of the funnel; and an outlet port disposed on the second end of the funnel;

a core disposed within the funnel, the core defining a first outer diameter, wherein the outlet port has an inner diameter that is less than the first outer diameter of the core;

a first coating disposed on and surrounding an outer surface of the core, the first coating defining a second outer diameter, the first coating configured to dissolve at a first dissolution rate in response to being exposed to water;

a second coating disposed on and surrounding an outer surface of the first coating, the second coating defining a third outer diameter, the second coating configured to dissolve at a second dissolution rate different from the first dissolution rate in response to being exposed to water; and a third coating disposed on and surrounding an outer surface of the second coating, the third coating defining a fourth outer diameter, the third coating configured to dissolve in response to being exposed to a hydrocarbon.

2. The apparatus of claim 1, wherein the second dissolution rate of the second coating is less than the first dissolution rate of the first coating.

3. The apparatus of claim 2, wherein the first coating has a first thickness, the second coating has a second thickness, and a difference between the first thickness and the second thickness is less than 0.1 centimeters.

4. The apparatus of claim 3, wherein the third coating has a third thickness, and a difference between the third thickness and the first thickness is less than 0.1 centimeters.

5. The apparatus of claim 4, wherein the third thickness is in a range of from about 50% to about 100% of the first thickness.

6. The apparatus of claim 5, wherein the core coated with the first coating, the second coating, and the third coating is disposed between the first end and the second end of the funnel.

7. The apparatus of claim 6, wherein the second inlet port of the plurality of inlet ports is disposed on the wall of the funnel at a first distance from the first end along the longitudinal axis, wherein the wall has a third cross-sectional area at the first distance, the third cross-sectional area perpendicular to the longitudinal axis, the third cross-sectional area having an inner diameter that is less than the third outer diameter and greater than the second outer diameter.

8. The apparatus of claim 7, wherein a third inlet port of the plurality of inlet ports is disposed on the wall of the funnel at a second distance from the first end along the longitudinal axis, wherein the wall has a fourth cross-sectional area at the second distance, the fourth cross-sectional area perpendicular to the longitudinal axis, the fourth cross-sectional area having an inner diameter that is less than the second outer diameter and greater than the first outer diameter.

9. A method comprising:

disposing an apparatus within a wellbore formed in a subterranean formation, the apparatus comprising:

a funnel comprising:

a plurality of inlet ports and an outlet port;

a first end;

a second end; and a wall spanning from the first end to the second end, the wall defining a longitudinal axis through the first end and the second end, the wall having a first cross-sectional area at the first end and a second cross-sectional area at the second end, the first cross-sectional area and the second cross-sectional area perpendicular to the longitudinal axis;

wherein a first inlet port of the plurality of inlet ports is disposed on the first end of the funnel, and the outlet port is disposed on the second end of the funnel;

a core disposed within the funnel, the core defining a first outer diameter, wherein the outlet port has an inner diameter that is less than the first outer diameter of the core;

a first coating disposed on and surrounding an outer surface of the core, the first coating defining a second outer diameter, the first coating configured to dissolve at a first dissolution rate in response to being exposed to water;

a second coating disposed on and surrounding an outer surface of the first coating, the second coating defining a third outer diameter, the second coating configured to dissolve at a second dissolution rate different from the first dissolution rate in response to being exposed to water; and a third coating disposed on and surrounding an outer surface of the second coating, the third coating defining a fourth outer diameter, the third coating configured to dissolve in response to being exposed to a hydrocarbon;

receiving, by the plurality of inlet ports of the funnel, wellbore fluid from the subterranean formation, the wellbore fluid comprising a hydrocarbon and water;

directing, by the funnel, the wellbore fluid to the core;

contacting the third coating with the hydrocarbon of the wellbore fluid to dissolve the third coating;

in response to dissolving the third coating, moving the core toward the outlet port and exposing the second coating to the wellbore fluid;

contacting the second coating with the water of the wellbore fluid to dissolve the second coating;

in response to dissolving the second coating, obstructing, by the core with the second and third coatings dissolved, fluid communication between a first portion of the plurality of inlet ports and the outlet port, such that fluid flow through the apparatus and out of the outlet port decreases;

contacting the first coating with the water of the wellbore fluid to dissolve the first coating; and in response to dissolving the first coating, obstructing, by the core with the first, second, and third coatings dissolved, fluid communication between a remaining portion of the plurality of inlet ports and the outlet port, such that fluid flow through the apparatus and out of the outlet port is prevented.

10. The method of claim 9, wherein the second dissolution rate of the second coating is less than the first dissolution rate of the first coating.

11. The method of claim 10, wherein the first coating has a first thickness, the second coating has a second thickness, and a difference between the first thickness and the second thickness is less than 0.1 centimeters.

12. The method of claim 11, wherein the third coating has a third thickness, and a difference between the third thickness and the first thickness is less than 0.1 centimeters.

13. The method of claim 12, wherein the third thickness is in a range of from about 50% to about 100% of the first thickness.

14. The method of claim 13, wherein the core coated with the first coating, the second coating, and the third coating is disposed between the first end and the second end of the funnel.

15. The method of claim 14, wherein a second inlet port of the plurality of inlet ports is disposed on the wall of the funnel at a first distance from the first end along the longitudinal axis, wherein the wall has a third cross-sectional area at the first distance, the third cross-sectional area perpendicular to the longitudinal axis, the third cross-sectional area having an inner diameter that is less than the third outer diameter and greater than the second outer diameter, such that a center of the core with the second and third coatings dissolved is disposed between the second inlet port and the outlet port, thereby obstructing fluid communication between the first portion of the plurality of inlet ports and the outlet port.

16. The method of claim 15, wherein a third inlet port of the plurality of inlet ports is disposed on the wall of the funnel at a second distance from the first end along the longitudinal axis, wherein the wall has a fourth cross-sectional area at the second distance, the fourth cross-sectional area perpendicular to the longitudinal axis, the fourth cross-sectional area having an inner diameter that is less than the second outer diameter and greater than the first outer diameter, such that the center of the core with the first, second, and third coatings dissolved is disposed between the third inlet port and the outlet port, thereby obstructing fluid communication between the plurality of inlet ports and the outlet port, such that fluid flow through the apparatus and out of the outlet port is prevented.

17. A system comprising:

a tubular disposed within a wellbore formed in a subterranean formation; and an inflow control device disposed on the tubular, the inflow control device configured to control flow of wellbore fluid from the wellbore and into the tubular, the inflow control device comprising:

a funnel comprising:

a first end;

a second end;

a wall spanning from the first end to the second end, the wall defining a longitudinal axis through the first end and the second end, the wall having a first cross-sectional area at the first end and a second cross-sectional area at the second end, the first cross-sectional area and the second cross-sectional area perpendicular to the longitudinal axis, the first cross-sectional area greater than the second cross-sectional area;

a plurality of inlet ports, wherein a first inlet port of the plurality of inlet ports is disposed on the first end of the funnel, and a second inlet port of the plurality of inlet ports is disposed on the wall of the funnel; and an outlet port disposed on the second end of the funnel;

a core disposed within the funnel, the core defining a first outer diameter, wherein the outlet port has an inner diameter that is less than the first outer diameter of the core;

a first coating disposed on and surrounding an outer surface of the core, the first coating defining a second outer diameter, the first coating configured to dissolve at a first dissolution rate in response to being exposed to water;

a second coating disposed on and surrounding an outer surface of the first coating, the second coating defining a third outer diameter, the second coating configured to dissolve at a second dissolution rate different from the first dissolution rate in response to being exposed to water; and a third coating disposed on and surrounding an outer surface of the second coating, the third coating defining a fourth outer diameter, the third coating configured to dissolve in response to being exposed to a hydrocarbon.

18. The system of claim 17, wherein the core coated with the first coating, the second coating, and the third coating is disposed between the first end and the second end of the funnel, the second inlet port of the plurality of inlet ports is disposed on the wall of the funnel at a first distance from the first end along the longitudinal axis, wherein the wall has a third cross-sectional area at the first distance, the third cross-sectional area perpendicular to the longitudinal axis, the third cross-sectional area having an inner diameter that is less than the third outer diameter and greater than the second outer diameter, and a third inlet port of the plurality of inlet ports is disposed on the wall of the funnel at a second distance from the first end along the longitudinal axis, wherein the wall has a fourth cross-sectional area at the second distance, the fourth cross-sectional area perpendicular to the longitudinal axis, the fourth cross-sectional area having an inner diameter that is less than the second outer diameter and greater than the first outer diameter.

* * * * *